US011274511B2

(12) United States Patent
Shampine

(10) Patent No.: US 11,274,511 B2
(45) Date of Patent: Mar. 15, 2022

(54) TOOL POSITIONING TECHNIQUE

(71) Applicant: Schlumberger Technology Corporation, Sugar Land, TX (US)

(72) Inventor: Rod William Shampine, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/969,457

(22) PCT Filed: Feb. 14, 2019

(86) PCT No.: PCT/US2019/017927
§ 371 (c)(1),
(2) Date: Aug. 12, 2020

(87) PCT Pub. No.: WO2019/161005
PCT Pub. Date: Aug. 22, 2019

(65) Prior Publication Data

US 2020/0370380 A1 Nov. 26, 2020

Related U.S. Application Data

(60) Provisional application No. 62/630,447, filed on Feb. 14, 2018.

(51) Int. Cl.
*E21B 33/06* (2006.01)
*E21B 19/22* (2006.01)
(Continued)

(52) U.S. Cl.
CPC ..... *E21B 19/22* (2013.01); *E21B 47/092* (2020.05); *E21B 33/061* (2013.01); *E21B 33/068* (2013.01); *E21B 47/085* (2020.05)

(58) Field of Classification Search
CPC ..... E21B 33/06; E21B 33/061; E21B 33/062; E21B 33/068; E21B 33/072; E21B 33/076
See application file for complete search history.

(56) References Cited

U.S. PATENT DOCUMENTS 3,435,895 A 4/1969 Lee
3,556,209 A * 1/1971 Reistle, III ..... E21B 33/076 166/352

(Continued)

FOREIGN PATENT DOCUMENTS

WO 2005038192 A1 4/2005

*Primary Examiner* — Giovanna Wright
(74) *Attorney, Agent, or Firm* — Michael L. Flynn

(57) ABSTRACT

Systems and techniques for locating a tool component in a channel of a blowout preventer. The system and technique may include the use of glide rams that are configured to sealably engage a deployment bar of a toolstring supporting the tool component in the channel. The glide rams may allow for movement of the deployment bar and toolstring while maintaining the seal. Due to greater diameter of the tool component, contact with the rams may be detected in the form of a spike in load detected at an oilfield surface by equipment supporting the conveyance means for the toolstring. Thus, tool component location may be ascertained. This same diameter difference of the tool component may also be utilized to deflect a member in the channel for sake of tool location.

17 Claims, 7 Drawing Sheets

(51) Int. Cl.

| | |
|---|---|
| ***E21B 47/092*** | (2012.01) |
| *E21B 47/085* | (2012.01) |
| *E21B 33/068* | (2006.01) |

(56) References Cited

U.S. PATENT DOCUMENTS

| | | | | |
|---|---|---|---|---|
| 10,801,293 | B2 * | 10/2020 | Shampine | E21B 33/068 |
| 2002/0117308 | A1 | 8/2002 | Dallas | |
| 2010/0163243 | A1 | 7/2010 | Sbordone | |
| 2012/0193104 | A1 | 8/2012 | Hoffman et al. | |
| 2018/0038188 | A1 | 2/2018 | Shampine | |

* cited by examiner

TOOL POSITIONING TECHNIQUE

CROSS REFERENCE TO RELATED APPLICATION(S)

This Patent Document priority under 35 U.S.C. § 119 to U.S. Provisional Application Ser. No. 62/630,447, entitled Tool Locating Means for Existing Deployment Systems, filed on Feb. 14, 2018, which is incorporated herein by reference in its entirety.

BACKGROUND

Exploring, drilling and completing hydrocarbon and other wells are generally complicated, time consuming, and ultimately very expensive endeavors. As a result, over the years, a significant amount of added emphasis has been placed on well profiling, monitoring and maintenance. By the same token, perhaps even more emphasis has been directed at initial well architecture and design. All in all, careful attention to design, monitoring and maintenance may help maximize production and extend well life. Thus, a substantial return on the investment in the completed well may be better ensured.

From the time the well is drilled and continuing through to various stages of completions and later operations, profiling and monitoring of well conditions may play a critical role in maximizing production and extending the life of the well as noted above. Certain measurements of downhole conditions may be ascertained through permanently installed sensors and other instrumentation. However, for a more complete picture of well conditions, an interventional logging application may take place with a logging tool advanced through the well. In this way depth correlated information in terms of formation characteristics, pressure, temperature, flowrate, fluid types, and others may be retrieved. So, for example, an overall production profile of the well may be understood in terms of the dynamic contributions of various well segments. This may provide operators with insight into expected production over time and guidance in terms current or future corrective maintenance. Of course, the well may require the introduction of an interventional application for sake of installation, retrieval, clean-out or any number of other issues that may arise throughout the life of the well.

Regardless, interventional applications have become a more complicated undertaking over the years. Specifically, wells are now more likely to be of greater depths and more complex architecture. Continuing with the example of a logging intervention, as opposed to merely dropping the logging tool into a vertical well in order to acquire readings, the logging tool may need to be routed through different tortious horizontal sections. Thus, coiled tubing is often employed for advancement of the logging tool through the entirety of the well.

During a coiled tubing operation, a spool of pipe (i.e., a coiled tubing) with a downhole tool at the end thereof is slowly straightened and forcibly pushed into the well. This may be achieved by running coiled tubing from the spool, at a truck or large skid, through a gooseneck guide arm and injector which are positioned over the well at the oilfield. In this manner, forces necessary to drive the coiled tubing through the deviated well may be employed, thereby advancing the tool through the well.

Advancing the logging tool through the well with coiled tubing first requires that the tool and the coiled tubing be deployed through a blowout preventer at the wellhead. The blowout preventer is the hardware utilized at the wellhead as a matter of safety and well control to ensure that the well itself remains sealed off and isolated from the environment of the oilfield. This works by positioning the tool and leading end of the coiled tubing into the blowout preventer with a master valve at the bottom thereof in a closed position. The blowout preventer may then sealingly engage with a higher point on the coiled tubing, the master valve opened and the coiled tubing advanced through the blowout preventer and well head therebelow. Indeed, this manner of deployment is generally utilized whether the intervention is coiled tubing driven, wireline or by some other mode. In the case of coiled tubing, an injector and other equipment are also utilized to further assure isolation between the well and the environment of the oilfield.

The described scenario of blowout preventer deployment is also utilized during retrieval of the coiled tubing and tool, though in reverse. Regardless, challenges are presented when the logging tool is of an extensive length. That is, the ability of the tool to be fully received within the blowout preventer with sealing thereabove before opening a master valve therebelow may be quite difficult when the tool is 50-100 feet in length or more as is the case with many more sophisticated logging tools currently available. This is also true for a variety of other interventional tools. In many cases, this challenge is addressed through the use of a riser assisted technique. In theory, a tubular riser may be of any practical height and circumference for accommodating the tool. Thus, the coiled tubing secured tool may be placed within a sealed riser that is run through the blowout preventer. In this way, the riser may provide an outer surface against which the blowout preventer may seal and allow for opening of the valve and advancement of the tool within the riser until sealing against the coiled tubing is available.

The riser assisted technique of deployment (or retrieval) helps address the issue of allowing sealing against the deployed equipment in spite of the excessive length of the tool that itself cannot be sealed against. Unfortunately though, as a practical matter, the issue of dealing with the deployment and retrieval of tools of such excessive lengths remains for other reasons. Specifically, a crane or raised platform may be utilized to position the riser and tool vertically over the well. However, when considering the cumulative height of the wellhead, plus the blowout preventer, plus a riser large enough to hold a 50-100 ft. tool, the platform or crane elevation needed to erect all of this equipment vertically can readily become impractical.

In order to reduce the height of extensive tools for sake of a more practical deployment and later retrieval, efforts to segment such tools have been suggested with the tool being separated into three, four or more segments with a deployment bar located between adjacent segments. That is, a tool segment may be provided with a deployment bar coupled thereto, followed by another tool segment that is coupled to the deployment bar. Subsequently, another deployment bar may be coupled to this other tool segment and this process may continue until a toolstring of tool segments and intervening deployment bars is completed. In theory, during deployment or retrieval a tool segment may be advanced into the blowout preventer with sealing taking place sequentially at a deployment bar above the tool segment and/or with the master valve at another deployment bar below the tool segment. This type of sealing above and below each tool segment may be repeated as the tool segments are deployed or retrieved from the well. Unfortunately however, this technique of moving a segmented tool through a blowout preventer takes place without any visibility to where a given tool segment actually is during sealing thereabove or below. Thus, the technique presents the possibility of sealing against a tool segment and damaging the tool, losing the seal or even risking a blowout. This is particularly of concern during tool retrieval due to the possibility of coiled tubing stretching during deployment which can make ascertaining the precise position of tool segments nearly impossible.

SUMMARY

A method of moving a toolstring through a blowout preventer is disclosed wherein the toolstring is moved through a channel of the preventer. A pair of glide rams and/or a deflectable member may be contacted by a tool component of the toolstring. This contact may be detected and translate into changing positions of rams at the channel.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments herein are described with reference to certain types of logging applications. For example, a logging tool may be provided in the form of an extended toolstring of alternating logging tool components and deployment bars. Of course, a variety of different types of application tools may take advantage of the unique deployment and tool component locating features detailed herein. For example, the toolstring may be adapted for performing different types of interventional applications such as a coiled tubing driven cleanout. Regardless, so long as the toolstring incorporates deployment bars capable of being sealed against within a blowout preventer and the preventer includes tool locating functionality therein, appreciable benefit may be realized.

Figure 1A:
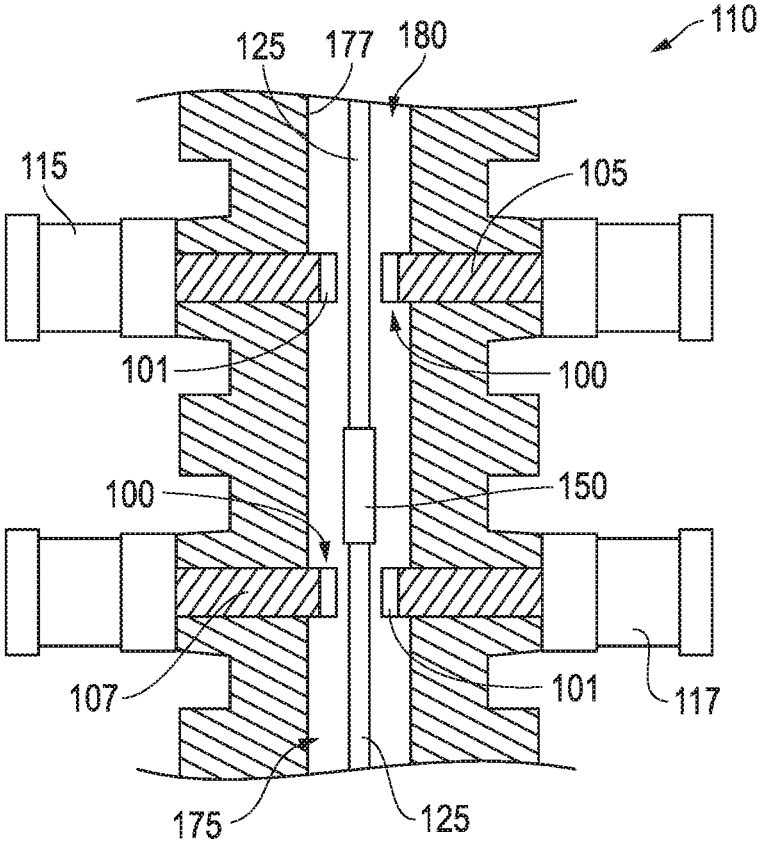
FIG. 1A is a side cross sectional view of an embodiment of a blowout preventer equipped with glide rams for locating a tool component of a toolstring.

Referring now to FIG. 1A, a side cross sectional view of an embodiment of a blowout preventer 110 is shown equipped with glide rams 105, 107 for locating a tool component 150 of a toolstring 175. The glide rams 105, 107 are configured for safely interfacing with an exterior surface of a downhole toolstring 175 at deployment bars 125 or coiled tubing 200 (see FIG. 2). As used herein, a glide ram is a device or pair of devices that utilizes an interface surface, such as the insert 130 defined hereinbelow, to engage with objects therebetween, such as, but not limited to, the exterior surface of the toolstring 175. However, techniques are detailed herein to locate other tool components (e.g. 150) within a channel 180 of the blowout preventer 110 to help avoid interfacing with the rams 105 during deployment or retrieval of the toolstring 175. In this way, tool damage, blowout or other undesirable events may be avoided.

Figure 6:
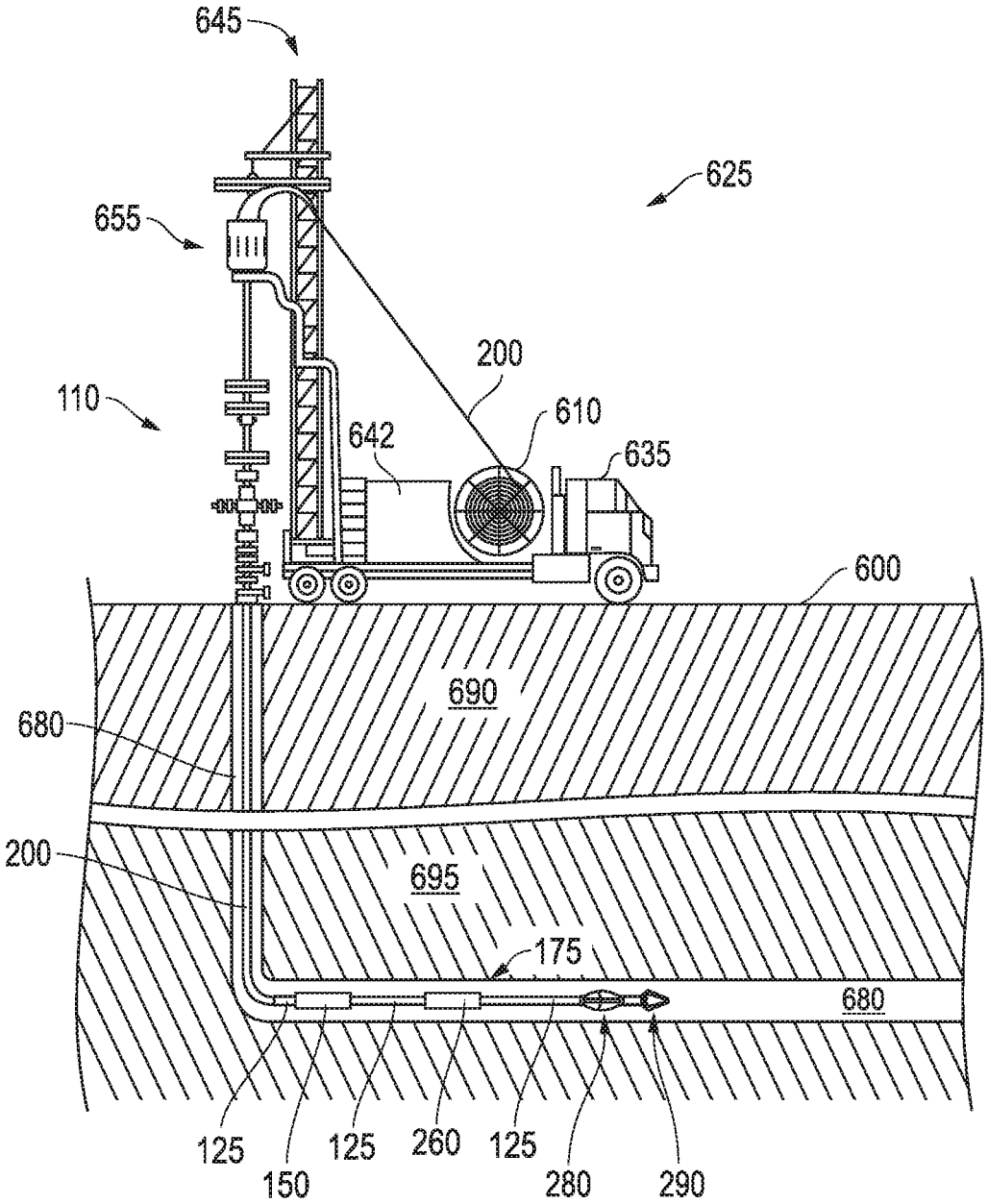
FIG. 6 is an overview of an oilfield with a well accommodating the toolstring of FIG. 2 routed through the tool locating equipped blowout preventer of either FIG. 1A or 5A.

The blowout preventer 110 is a piece of equipment generally utilized at an oilfield 600 to help maintain isolated pressure control over a well 380 (see FIG. 6). Thus, in addition to providing a guide-path for well access, the preventer 110 may help to avoid undesired consequences of losing well control, such as a blowout, as the name suggests. In the embodiment of FIG. 1A, features of the blowout preventer 110 include valves 115 with glide rams 105, 107 for emerging from a sidewall 177 defining the channel 180 through the preventer 110. Thus, the respective interface surfaces of these glide rams 105, 107 may engage with or sealably engage with the toolstring 175 as needed.

With added reference to FIG. 1B, the ends of these elements 105, 107 may be specially configured with a glide region or interface surface 100 to allow them to serve a glide function with respect to non-tool components of the toolstring 175 as detailed below. In the embodiment depicted, this includes interfacing with deployment bars 125 or coiled tubing 200 (see FIG. 2). However, in other embodiments, this gliding interface may take place at jointed pipe or even at tractor supported wireline or slickline. In terms of the engagement at the glide region 100, the rams 105, 107 terminate at an insert 130 with a semicircular face 101. The rams 105, 107 may be configured with a capacity to impart up to about 10,000 lbs. of radial force on the toolstring 175 at non-tool component locations as noted. However, to facilitate a sealed, gliding interface with movement between a deployment bar 125 and the face 101 as described below, radial force may be kept below about 5,000 lbs. when the face 101 engages a bar 125.

Whether the toolstring 175 is stationary or moving, the elements 105 or 107 may be actuated as indicated to interface the toolstring 175 from opposite sides thereof. In this manner, a conformal seal about the toolstring 175 is achieved which helps assure that well control is maintained, for example, even if a well valve below the blowout preventer 110 has been opened (e.g. to allow for well access via the channel 180). As a result, an operator may be allowed to thread a device such as the toolstring 175 through the preventer 110 in an incremental fashion. Of course, the blowout preventer 110 is also equipped with additional features such as shear rams to cut the toolstring 175, coiled tubing or other devices should the need for immediate well control isolation arise.

Continuing with reference to FIG. 1A, both sets of rams 105, 107 are shown open with the toolstring 175 being passed through the noted channel 180. However, as noted above, and detailed further below, the need to periodically close or seal rams 105, 107 about the toolstring 175 arises for sake of maintaining well control when accessing a channel 180 that leads to the well 680 (again, see FIG. 6). Once more, as a matter of allowing for assembly of the toolstring 175 on-site for a practical deployment, it may be made up of individual components such as a sonde 150 secured to deployment bars 125. In this way, rather than attempt to introduce an extensively long pre-manufactured toolstring 175 of say over 50 feet or more, one toolstring component may be partially advanced into the blowout preventer 110, followed by securing thereof to a deployment bar 125, then another component (e.g. 150), then another deployment bar 125, and so forth. As a result, the toolstring 175 may be considered a segmented toolstring 175 which is advanced downward into the blowout preventer 110 at the same time that it is attaining length. Thus, the need to provide a platform of impractical deployment heights of 50 to 100 feet or more over the preventer 110 in order to drop in the toolstring 175 may be avoided.

While deployment may be aided with a tubular riser as noted above, this may not always be desirable. Once more, where the toolstring 175 is, for example, logging equipment run on coiled tubing, during withdrawal, the opportunity to utilize a tubular riser may not be available. Instead, the rams 105, 107 are configured to engage specifically with deployment bars 125 of the described toolstring 175 which are better suited to take on such sealing forces without structural harm thereto. In this way a potentially harmful or compromised sealing with larger diameter, more irregular components (e.g. 150) of the toolstring 175 may be avoided. As described below, visibility as to the location of such components is provided by way of force sensing through the rams 105 or 107 when a shoulder of the tool component 100 contacts the rams 105 and brings advancement of a bar 125 at the interface surface or glide region 100 to a halt.

Detection of this halt may occur in the form of detecting a sudden increase in load at surface (e.g. at the coiled tubing injector 655). This may result in an operator responding by sequentially opening and closing ram pairs 150, 107 depending on specific operational sequences (e.g. see the exemplary coiled tubing deployment and withdrawal sequences detailed with reference to FIGS. 3A-3D and 4A-4D below). Regardless, in this manner, well control may be maintained throughout.

Figure 2:
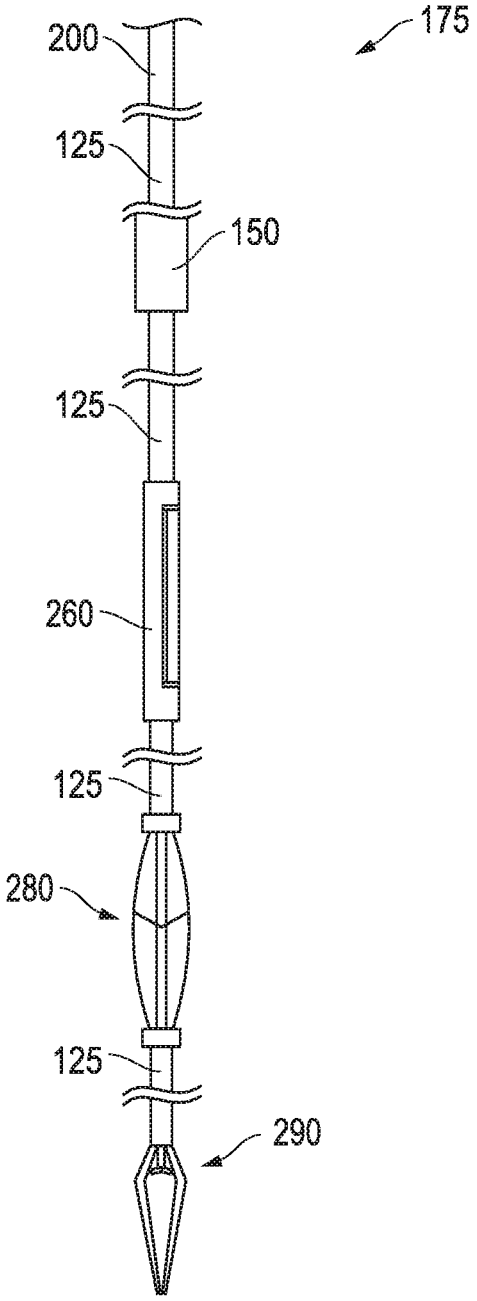
FIG. 2 is a side view of the toolstring of FIG. 1A with a plurality of tool components of varying diameters greater than that of associated deployment bars and coiled tubing.

With added reference to FIG. 2, attaining knowledge of tool component location within the blowout preventer 110 as described above may be beneficial where the deployment is by way of coiled tubing. This may be particularly true during withdrawal of the toolstring 175. For example, where the toolstring 175 is utilized for a logging application several thousand feet into a well and delivered by way of coiled tubing 200, the possibility of bending, stretching and other factors may make ascertaining the precise location of the toolstring 175 and its components (e.g. 150) challenging. That is, in such circumstances, the reeling back in of the coiled tubing 200 over a reel 610 following an application may not match the same amount that is let out at the outset of the application due to the noted stretching (see FIG. 6). Thus, a direct confirmation of the location of the toolstring components when a tool component 150 halts upward movement at a pair of closed glide rams 105, 107 is of benefit.

Figure 1B:
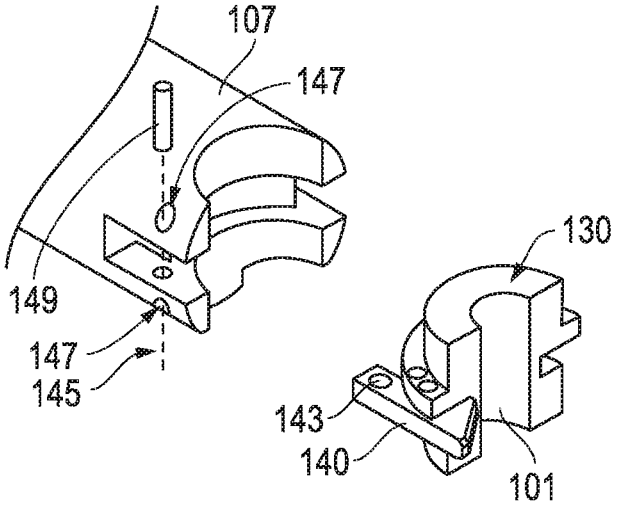
FIG. 1B is an exploded partial view of a glide ram of FIG. 1A illustrating a glide insert for interfacing with the toolstring of FIG. 1A.

With more specific reference to FIG. 1B, an exploded partial view of a glide ram 107 of FIG. 1A is shown illustrating a glide insert 130 for interfacing with the toolstring 175 of FIG. 1A as described above. Unlike a conventional ram interface, the interface surface or face 101 of the insert 130 may be a solid, smooth, non-gripping surface substantially absent of any gripping contours. In one embodiment the face 101 is brass or other suitable material to withstand the oilfield environment while minimizing risk of damage to moving tool components 150 when they encounter a closed pair of rams 105, 107 as described above. Indeed, the entire insert 130 may be a monolithic brass component. Additionally, in this embodiment, the insert 130 is removable and replaceable, for example, when the ram 107 is no longer intended to serve a glide or slip function as described. In such cases, the insert 130 may be replaced with an insert supporting a gripping function for immovably sealing a toolstring 175 in place. Be that as it may, for the depicted embodiment, the insert 130 may be held in place by a pin 149 insertable through a conduit 147 of the ram 107. With an orifice 143 of an insert extension 140 aligned with an axis 145 of the conduit 147, the removable pin 149 may engage the insert 130 for securing in place.

Referring now to FIG. 2, a side view of the toolstring of FIG. 1A is depicted with a plurality of tool components 150, 260, 280, 290 of varying diameters greater than that of associated deployment bars 125 and coiled tubing 200. As indicated above, the toolstring 175 is configured for deployment by way of coiled tubing 200. Further, deployment bars 125 are utilized to serve as connection structure between adjacent tool components 150, 260, 280, 290 while also being durably configured for sealing engagement with rams 105, 107 as noted above. For compatibility with the coiled tubing 200, the deployment bars 125 may support internal fluid flow and substantially match the outer diameter of the coiled tubing 200. For example, in one embodiment, both the coiled tubing 200 and the deployment bars 125 are of a 2⅜ inch variety. Of course, any suitable size for the application at hand may be utilized. Additionally, like the coiled tubing 200, the deployment bars 125 are also capable of being sheared by shear rams of the blowout preventer 110 should the necessity arise (see FIG. 1A).

Due to the number of tool components 150, 260, 280, 290, the fully assembled toolstring 175 may be in excess of 50 feet in length, particularly when accounting for the addition of the deployment bars 125. However, due to the use of the deployment bars 125, the toolstring 125 may be assembled right on site over the blowout preventer 110 of FIG. 1A. Thus, as a practical matter, the operator will generally handle only a single bar 125 or component 150, 260, 280, 290 at any given point in time, either of which is likely under 30 feet in length. As illustrated herein, alternatingly coupling components 150, 260, 280, 290 with deployment bars 125 makes this type of on-site assembly and deployment possible. Further, utilizing a tool locating technique that employs glide rams 105, 107 that may be closed while facilitating toolstring movement makes this type of deployment through the blowout preventer 110 and, perhaps more beneficially, retrieval therefrom, practical and safe.

With added reference to FIG. 1A, the toolstring components depicted in FIG. 2, include a sonde 150 as alluded to above. The sonde 150 is equipped to acquire basic measurements such as pressure, temperature, casing collar location and others. For illustrative purposes, the sonde 150 above has been referred to as a tool component that may be detected upon encountering closed glide rams 105, 107. However, the same may be true for any other tool component as well (e.g. 260, 280 or 290). Further, a tool component may be configured with functionality that is dedicated to locating purposes. For example, a robust component having a diameter in excess of the coiled tubing 200, deployment bars 125 or other deployment means, may be utilized that is tailored to stably impacting closed glide rams 105, 107 for sake of detection. In one embodiment, such dedicated tool locating components may be the tool components that are positioned at the uppermost or lowermost locations of the toolstring 175 (or at both locations).

Continuing with reference to FIG. 2, density acquisition 260 and gas monitoring 280 components are also provided. In the embodiment shown, the toolstring 175 also terminates at a caliper and flow imaging component 290 which, in addition to imaging, may be employed to acquire data relative to tool velocity, water, gas, flow and other well characteristics. Readings from a logging toolstring 175 as described may be acquired as the toolstring 175 is forcibly advanced through a well 680 as shown in FIG. 6 by coiled tubing 200. Such readings may be stored and interpreted at surface following a logging application or perhaps relayed over fiber optics, wirelessly or via other means to surface equipment for real-time interpretation and use. Regardless, in spite of the extended length of the toolstring 175 with a host of different logging components utilized, a practical manner of deployment and retrieval is rendered through the combined use of deployment bars 125 with the tool locating techniques detailed herein (see FIG. 1A).

Referring now to FIGS. 3A-3D, side cross-sectional views of the toolstring 175 are shown as deployment bars 125 and a tool component 150 are sequentially put together and advanced through the blowout preventer 110. As noted above, this is done in a way that allows for the segmented assembly of the toolstring 175 on site over the preventer 110 in a manageable and practical way in terms of lengths of the assembled components. Once more, due to the unique manner of detecting tool component 150 location once in the channel 180 of the preventer, well control may be maintained throughout the deployment process as described below.

Figure 3A:
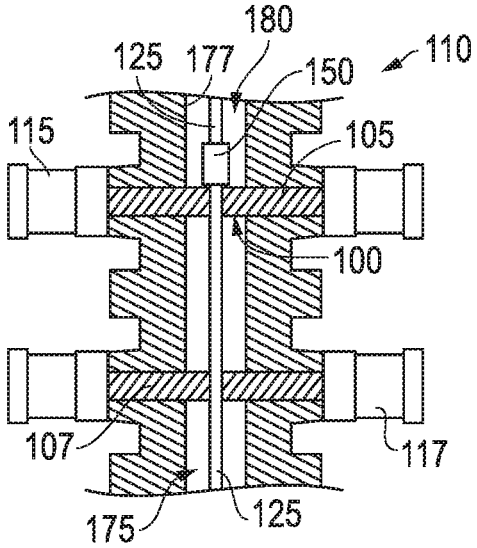
FIG. 3A is a side cross-sectional view of the toolstring being deployed into the blowout preventer of FIG. 1A with tool component detection by upper glide rams of the preventer.

With specific reference to FIG. 3A, the toolstring 175 is advanced through the channel 180 with both pairs of glide rams 105, 107 in a closed position, for example sealed about a first deployment bar 125. However, at some point, the advancing toolstring 175 will result in the delivery of a tool component 150 to the uppermost set of rams 105. Due to the diameter of the component 150 being greater than the passage at the interface surface or glide region 100 when the rams 105 are closed, advancement of the toolstring 175 may be halted, at least temporarily. However, with added reference to FIG. 6, the halting of this advancement may be immediately detected at the oilfield. More specifically, in the embodiments here, the toolstring 175 is forcibly advanced into the preventer 110 by an injector 655. Thus, with the tool component 150 meeting the rams 105 and stopping advancement, a sudden spike in load would result at the injector 655. As a result, an indication as to the location of the tool component 150 in the channel 180 would be provided.

Figure 3B:
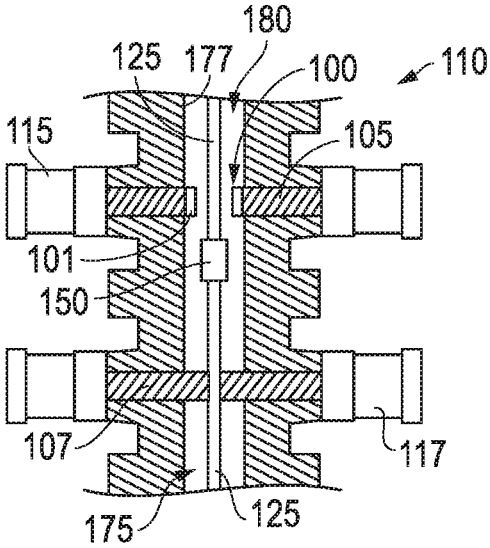
FIG. 3B is a side cross-sectional view of the upper glide rams of FIG. 3A opening to allow continuation of toolstring deployment.
Figure 3C:
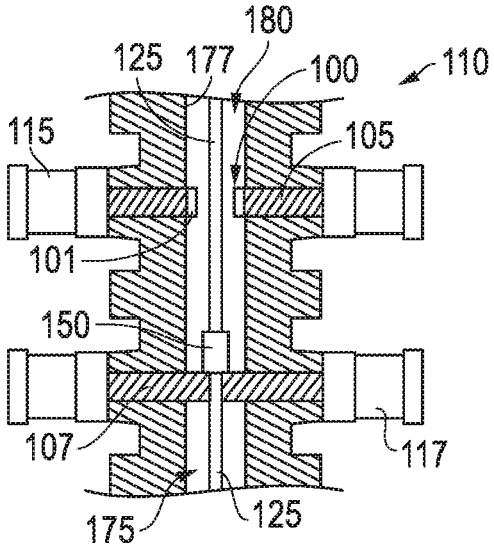
FIG. 3C is a side cross-sectional view of FIG. 3B with detection of the tool component by lower glide rams of the preventer.

Referring now to FIG. 3B, with the location of the component 150 known, the upper rams 105 may be opened to allow passage of the tool component 150. To avoid closing on the tool component 150, the rams 105 may be reclosed upon advancing the toolstring 175 further for a known distance that is greater than the length of the tool component 150. Alternatively, as shown in FIG. 3C, and for added precaution, the uppermost rams 105 may be kept open until the tool component 150 again interfaces the next closed set of rams 107. This next interfacing with closed rams 107 by the component 150 will again be confirmed by another spike in load detected at the injector 655 of FIG. 6.

Figure 3D:
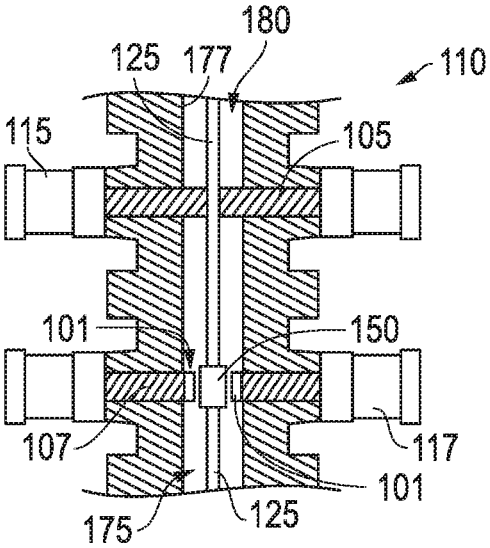
FIG. 3D is a side cross-sectional view of FIG. 3C with closure of the upper glide rams and opening of the lower glide rams to allow continuation of toolstring deployment out of the preventer.

With this subsequent spike in load detected, the uppermost rams 105 may again be closed and the lower rams 107 opened as shown in FIG. 3D to allow for continued advancement of the toolstring 175. In this manner, the tool component 150 may be advanced through the channel 180 without loss of well control and without risk of rams 105, 107 closing on the component. Of course, this may be repeated for each component 150, 260, 280, 290 of a toolstring 175 such as that depicted in FIG. 2.

Referring now to FIGS. 4A-4D, with added reference to FIG. 6, retrieval of a toolstring 175 from a well 680 and through the blowout preventer 110 appears to be the reverse of deployment as described above. However, recall that retrieval of a coiled tubing 200 deployed toolstring 175 differs a great deal in terms of practical aspects. That is, unlike the circumstance where a segmented toolstring 175 is assembled and advanced into an adjacent preventer 110, withdrawal of the toolstring 175 may involve vast amounts of distance through a tortuous well 680. Several thousand feet of deployment, bending, stretching and other movement means that ascertaining the precise location of tool components 150, 260, 280, 290 when the toolstring 175 is being brought back into the preventer 110 is not a realistic undertaking if based solely on examining the amount of coiled tubing withdrawn.

Figure 4A:
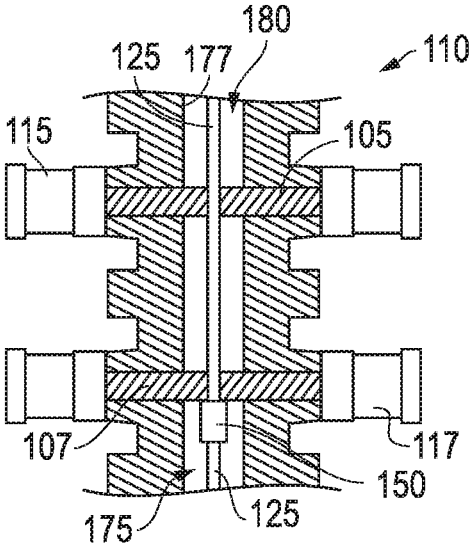
FIGS. 4A-4D are side cross-sectional views of the blowout preventer of FIGS. 3A-3D employing the glide rams to safely locate tool components during toolstring retrieval.
Figure 4B:
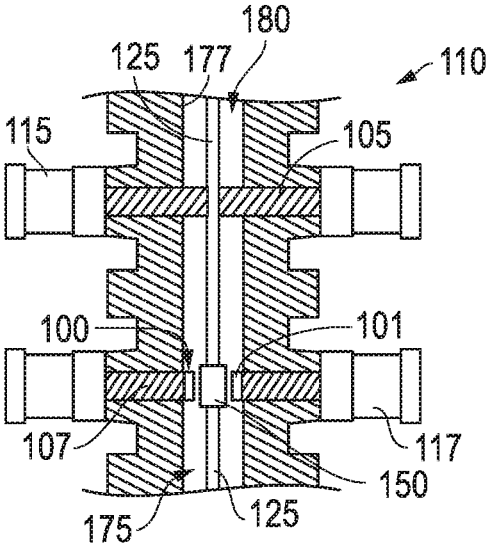
Figure 4C:
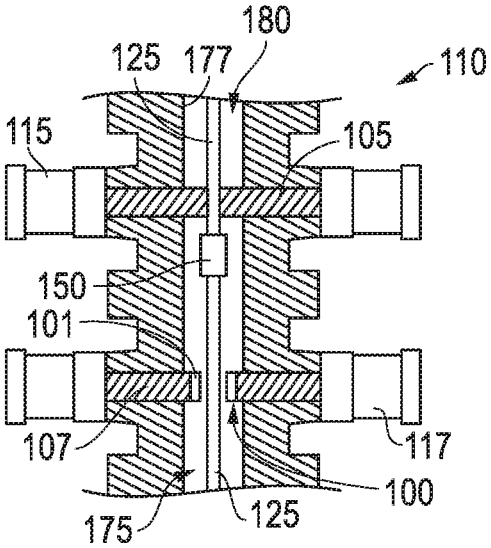
Figure 4D:
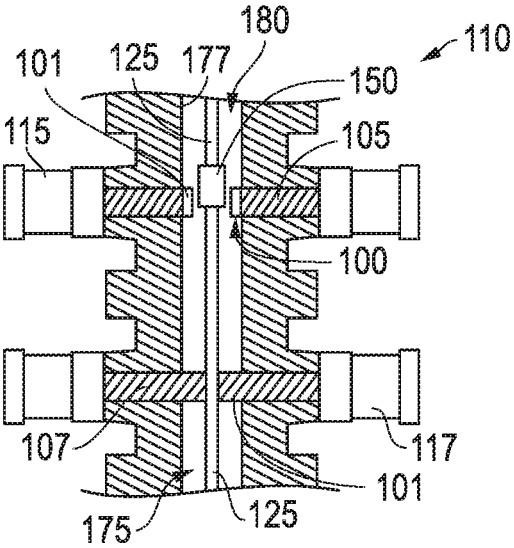

Instead, with the lowermost glide rams 107 closed, the coiled tubing 200 and toolstring 175 may be withdrawn until contact is made by the tool component 150 as shown at FIG. 4A. A spike in load would again be detected at surface, only now based on pulling on the coiled tubing 200 as opposed injecting. Regardless, this spike detection may lead to opening of the lower rams 107 as shown at FIG. 4B. The tool component 150 may then be advanced to the upper rams 105 as shown at FIG. 4C which would lead to another spike detection and opening at the upper rams as shown at FIG. 4D. At this point, the lower rams 107 may be safely closed on the deployment bar 125.

Figure 5A:
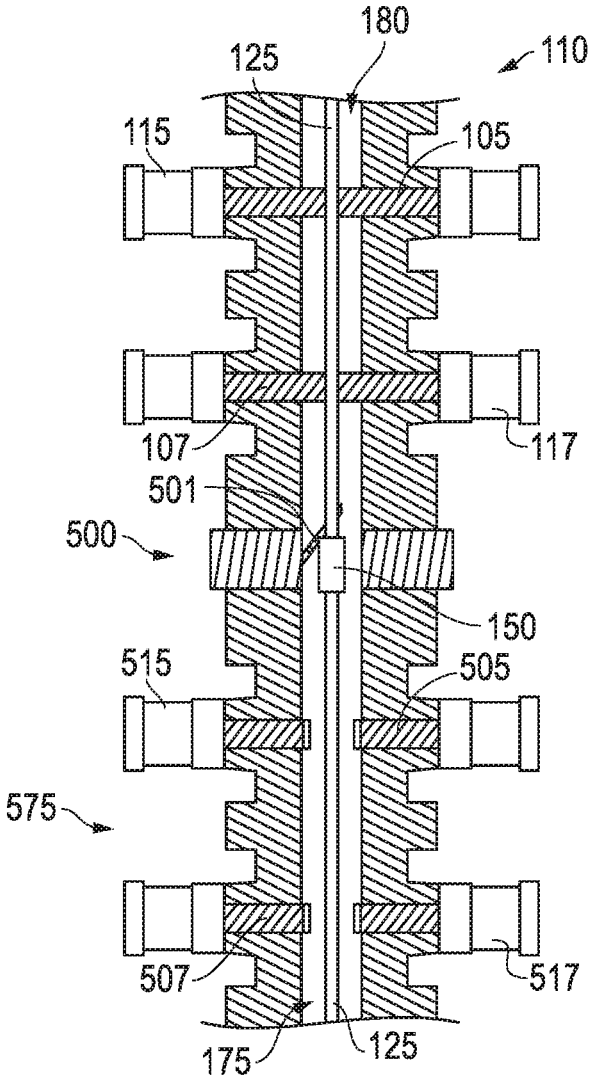
FIG. 5A is a side cross-sectional view of another embodiment of a blowout preventer employing a tool trap locator therein for locating of a tool component of the toolstring of FIG. 2.
Figure 5B:
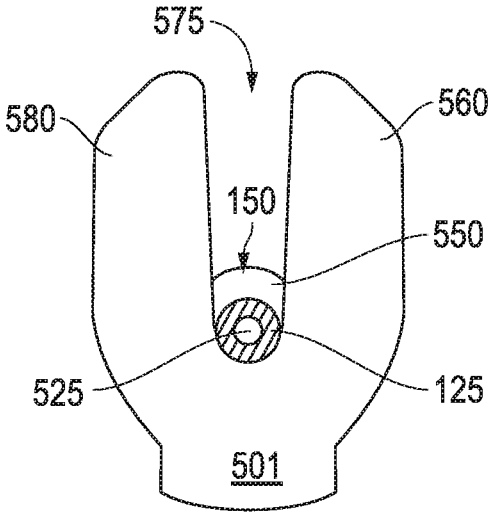
FIG. 5B is a top view of the tool trap locator of FIG. 5A with partial cross-section of the toolstring during interface with the tool component.

Referring now to FIGS. 5A and 5B, an alternate embodiment of tool locating technique is depicted. In this case, rather than rely on contact between a tool component 150 and rams with a detected spike in load, the tool component 150 makes contact with a tool trap locator or deflectable member 501. That is, continuing with the example of the upward movement of withdrawing the toolstring 175 from the channel 180, lower rams 505, 507 may be kept open during withdrawal until the tool component 150 makes contact with an upwardly deflectable member 501 at a locating region 500 in the blowout preventer 110 (the opposite being the case during deployment). The member 501 may be spring supported to prevent accidental deflection or deflection due to interfacing with coiled tubing and/or deployment bars alone. However, deflection may not be avoided once encountering the sufficiently sized tool component 150. Detection of this deflection may be collected and relayed by conventional means to surface equipment such as the control unit 642 of FIG. 6.

Similar to the concepts above where detection of contact at a closed pair of rams allows for closure at another location as shown in FIG. 4D, the detection of the deflection in FIG. 5A may lead to the opening of the upper rams 105, 107 and the closure of the lower rams 505, 507. Thus, the toolstring 175 may continue to be withdrawn from the preventer 110. With added reference to FIG. 5B, the deflectable member 501 may be a modified, commonly available tool trap, a device that is often utilized to position and isolate a tool, for example where shearing of coiled tubing is necessitated. Indeed, the embodiment of FIGS. 5A and 5B is assembled in a manner taking advantage of commonly available equipment parts. That is, in contrast to the embodiment of FIGS. 3A-3D (or 4A-4D), the preventer 110 is made up of two separate stacked preventers with a tool trap region in between. However, this is not required.

Continuing with reference to the top view of the deflectable member 501 of FIG. 5B, the deployment bar 125 is shown in cross-section with a central flow path 525 to maintain fluid flow consistent and in line with coiled tubing 200 and the remainder of the toolstring 175 (see FIG. 2). Additionally, it is apparent that the curved bypass region 575 of the member 501 is sufficiently large enough to allow passage of the deployment bar 125 without resulting in any deflection of the member. Indeed, the member 501 and region 575 may also be configured to provide a degree of centralization prior to deflection so that the deployment bar 125 and toolstring 175 advance upward in a relatively centralized manner with respect to the channel 180. It is also apparent that the bypass region 575 is not large enough to allow the tool component 150 to pass without deflection. So, for example, in the embodiment shown, where the coiled tubing 200 and deployment bar 125 are of a 2⅜ inch variety, the bypass region 575 may range from 3-4 inches across from one arm 560 of the member 501 to the other 580 but not reach the size of the component 150 outer diameter (e.g. 5 inches or more).

Referring now to FIG. 6, an overview of an oilfield 600 is shown with a well 680 accommodating the toolstring 175 of FIG. 2 routed through the tool locating equipped blowout preventer 110 of either FIG. 1A or 5A. The well 680 is depicted accommodating the toolstring 175 during a logging application for building a production profile of the well 680. Advancement of the toolstring 175 as described above is directed via the coiled tubing 200. Surface delivery equipment 625, including a coiled tubing truck 635 with reel 610, is positioned adjacent the well 680 at the oilfield 600. With the coiled tubing 200 run through a conventional gooseneck injector 655 supported by a rig 645 over the well 680, the coiled tubing 200 may then be advanced once the toolstring 175 is assembled and secured thereto.

As noted above, assembling of the toolstring 175 may take place with an operator manually assembling things piece by piece at a platform just over the blowout preventer 110 before the injector 655 is secured thereto. Specifically, the operator may secure one component (e.g. 290) to a deployment bar 125, followed by another component 260, another bar 125, another component 260, another bar 125, another component 150 and finally another bar 125. This last deployment bar 125 may then be secured to the coiled tubing 200 that emerges from the injector 655 prior to securing of the injector 655 to the blowout preventer 110. The coiled tubing 200 may then be forced down through the preventer 110 and through the well 680 traversing various formation layers 690, 695 (e.g. allowing the production logging application to proceed).

As detailed above, in sequentially assembling and advancing the toolstring 175 into the preventer 110, a locating techniques that utilize component contact with rams or a deflecting member may periodically provide location information to the operator. In this way well control may be safely maintained and without compromise to tool components. This location information may be attained and analyzed by a control unit 642. In the embodiment shown, the control unit 642 is computerized equipment secured to the truck 635. However, the unit 642 may be of a more mobile variety such as a laptop computer. Furthermore, the unit 642 may be used to monitor logging readings or to direct the logging application itself among others.

Figure 7:
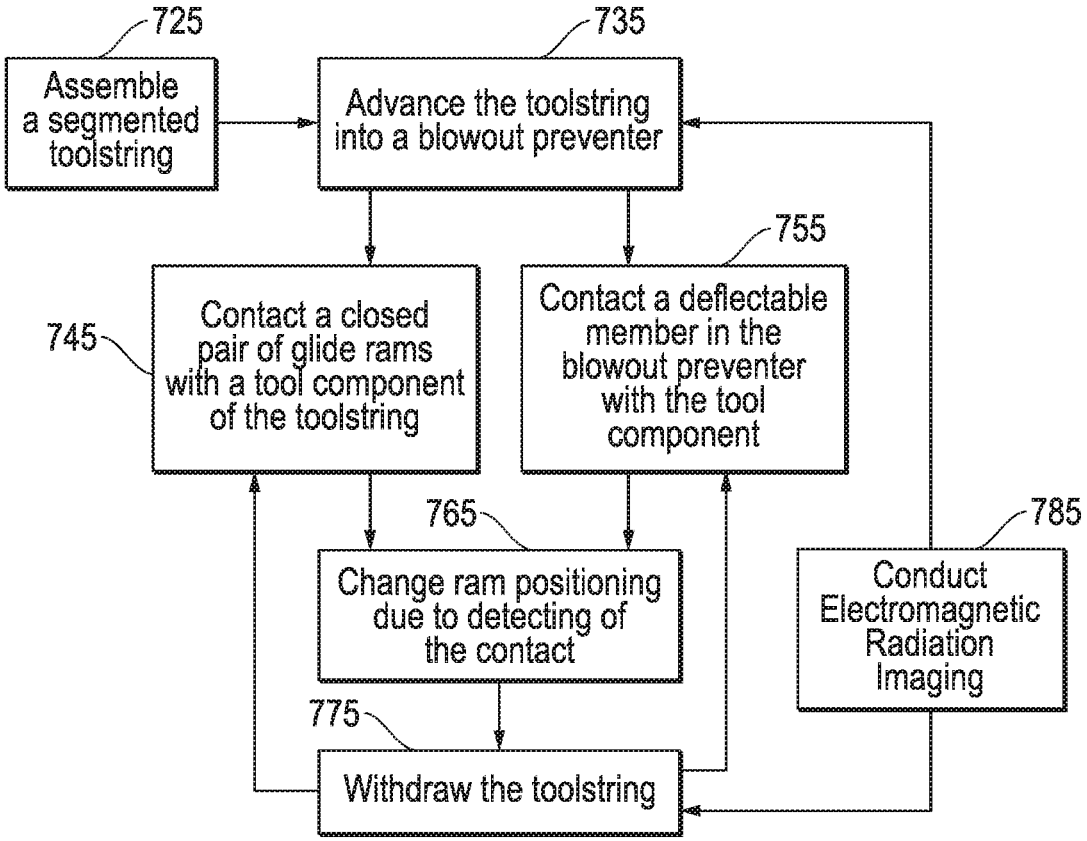
FIG. 7 is a flow-chart summarizing an embodiment of utilizing a tool locating device within a blowout preventer.

Referring now to FIG. 7, a flow-chart is shown which summarizes an embodiment of utilizing tool locating techniques within a blowout preventer. As indicated above, it is advantageous, in terms of practicality, to utilize segmented assembly of a toolstring over the blowout preventer (see 725). The segmented toolstring may be advanced into the blowout preventer as indicated at 735. In order to attain location visibility for tool components of the toolstring within the blowout preventer, detection of tool location may take place in a channel of the blowout preventer, whether by contact with a pair of glide rams 745 or by contact with a deflectable member 755. Either way, the detection allows for repositioning of glide ram pairs due to the known location of the tool component (see 765). This may include opening one pair while safely closing another at a deployment bar of the assembly. This process may be repeated until the entirety of the toolstring is safely through the blowout preventer and without risk of losing well control.

As indicated at 775, following a downhole toolstring application, the toolstring may be withdrawn from a well back toward the blowout preventer. Thus, depending on the preventer configuration, an uppermost tool component may eventually contact closed guide arms as indicated at 745 or the component may contact a deflectable member (see 755) in a detectable manner. Therefore, just as with the advancing of the toolstring in a downhole direction, ram positioning may change in response to the detected location of the tool component.

Additionally, whether the toolstring is being advanced downhole or withdrawn, electromagnetic imaging may take place to confirm the location of the tool components when traversing the internal channel of the blowout preventer (see 775). This may include tagging tool components with electromagnetic coding and utilizing high powered x-ray or gamma ray equipment at the blowout preventer to image the moving component within the preventer.

Embodiments described hereinabove provide devices and techniques that allow for a reduction in height necessary to achieve effective coiled tubing deployment and retrieval of toolstrings of excessive lengths. Once more, the devices and techniques may be implemented in a manner that provides visibility to the toolstring during deployment or retrieval through a blowout preventer. Thus, as a practical matter, the risk of unintentionally sealing against tool components is reduced thereby helping to ensuring a better seal and enhancing safety from an operator perspective while also safeguarding the high dollar toolstring components.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, while embodiments herein are particularly beneficial for coiled tubing driven applications, the techniques may be employed on wireline, slickline, jointed pipe or other conveyances as well. Furthermore, the foregoing description should not be read as pertaining only to the precise structures described and shown in the accompanying drawings, but rather should be read as consistent with and as support for the following claims, which are to have their fullest and fairest scope.

I claim:

1. A method of moving a toolstring through a blowout preventer, the method comprising:

assembling the toolstring in a segmented manner at a location of the blowout preventer;

moving the toolstring through a channel of the blowout preventer;

contacting one of a pair of glide rams and a deflectable member with a tool component of the toolstring, wherein the pair of glide rams is one of a plurality of rams pairs;

detecting the contacting; and changing positioning of a pair of rams of the plurality in response to the detecting.

2. The method of claim 1 further comprising employing the deflectable member to centralize one of a deployment bar of the toolstring and coiled tubing for conveying the toolstring in the channel prior to the contacting.

3. The method of claim 1 wherein the moving is in a downhole direction toward a well below the blowout preventer, the plurality of rams including an open pair above a closed pair with the deflectable member therebetween and the changing of the positioning comprising:

closing the open pair; and opening the closed pair.

4. The method of claim 1 wherein the moving is in an uphole direction from a well below the blowout preventer, the plurality of rams including a closed pair above an open pair with the deflectable member therebetween and the changing of the positioning comprising:

closing the open pair; and opening the closed pair.

5. The method of claim 1 further comprising conducting electromagnetic radiation imaging during the moving to monitor the position of the toolstring in the blowout preventer.

6. The method of claim 5 wherein the conducting of the electromagnetic radiation imaging comprises encoding a tool component with an electromagnetic tag prior to the moving of the toolstring through the channel.

7. The method of claim 5 wherein the electromagnetic radiation imaging is one of x-ray imaging and gamma ray imaging.

8. A method of moving a toolstring through a blowout preventer, the method comprising:

moving the toolstring through a channel of the blowout preventer, wherein the toolstring is supported by coiled tubing;

engaging a deployment bar of the toolstring with a pair of glide rams during the moving;

contacting the pair with a tool component of the toolstring;

detecting the contacting by detecting a spike in load at equipment securing the coiled tubing positioned at an oilfield accommodating the blowout preventer; and disengaging the pair of glide rams from the deployment bar in response to the detecting of the contacting.

9. The method of claim 8 wherein the tool component is of an outer diameter greater than that of the deployment bar to facilitate the contacting.

10. The method of claim 8 wherein the pair of glide rams is a first pair of glide rams of the blowout preventer and the deployment bar is a first deployment bar of the toolstring, the method further comprising:

maintaining an engagement with the first deployment bar of the toolstring with a second pair of glide rams of the blowout preventer;

contacting the second pair of glide rams with the tool component;

detecting the contacting;

closing the first pair of glide rams into engagement with a second deployment bar of the toolstring;

disengaging the second pair of glide rams from engagement with the first deployment bar; and advancing the tool component past the second pair of glide rams.

11. The method of claim 8 wherein the equipment is a coiled tubing injector for deployment of the toolstring and the spike in load is an increase in resistance to forcible advancement of the coiled tubing.

12. The method of claim 8 wherein the equipment is a coiled tubing reel for withdrawal of the toolstring and the spike in load is an increase in resistance to spooling of coiled tubing onto the reel.

13. A blowout preventer comprising:

a plurality of pairs of glide rams interfacing a channel through the preventer, the glide rams configured for sealably engaging a deployment bar of a toolstring and to facilitate movement of the bar during the engaging, wherein the glide rams comprise an interface surface with a face at a locating of the engaging, the face having a non-gripping surface; and a deflectable member disposed in the channel between pairs of the plurality, the toolstring having a component for contacting one of the deflectable member and a pair of the plurality to trigger disengagement of the rams from the deployment bar.

14. The blowout preventer of claim 13 wherein the deflectable member is a modified tool trap.

15. The blowout preventer of claim 13 wherein the interface surface is incorporated into a replaceable glide insert.

16. The blowout preventer of claim 15 wherein the glide insert is a monolithic brass element.

17. The blowout preventer of claim 13 wherein the toolstring is coupled to a conveyance selected from a group consisting of coiled tubing, jointed pipe, wireline and slickline.

* * * * *